United States Patent [19]

Waibel

[11] Patent Number: 4,859,096

[45] Date of Patent: Aug. 22, 1989

[54] IMPACT MECHANISM FOR IMPACT PRINTER

[75] Inventor: Helmut K. Waibel, Fremont, Calif.

[73] Assignee: Xerox Corporation, Stamford, Conn.

[21] Appl. No.: 206,556

[22] Filed: Jun. 14, 1988

[51] Int. Cl.[4] ..... B41J 9/133

[52] U.S. Cl. ..... 400/157.2; 101/93.31; 101/93.48

[58] Field of Search ..... 400/59, 63, 144.2, 144.3, 400/94, 248, 174, 175, 356, 354.3, 63, 157.1, 157.2, 370, 375.3, 376; 101/93.48, 93.15, 93.16, 93.17, 93.31

[56] References Cited

U.S. PATENT DOCUMENTS

| | | | |
|---|---|---|---|
| 4,023,662 | 5/1977 | Renucea | 400/59 X |
| 4,086,997 | 5/1978 | Wu | 400/59 X |
| 4,652,153 | 3/1987 | Kotsuzumi et al. | 400/59 X |
| 4,657,415 | 4/1987 | Kikuchi et al. | 400/59 |
| 4,668,112 | 5/1987 | Gabor et al. | 400/144.2 X |
| 4,678,355 | 7/1987 | Gabor et al. | 400/144.2 X |
| 4,681,469 | 7/1987 | Gabor | 400/144.2 X |
| 4,737,043 | 4/1988 | Gabor et al. | 101/93.43 |

FOREIGN PATENT DOCUMENTS

| | | | |
|---|---|---|---|
| 3322791 | 1/1985 | Fed. Rep. of Germany | 400/144.2 |
| 149387 | 7/1906 | Japan | 900/59 |
| 176189 | 10/1982 | Japan | 400/144.2 |

*Primary Examiner*—Edgar S. Burr
*Assistant Examiner*—James R. McDaniel
*Attorney, Agent, or Firm*—Serge Abend

[57] ABSTRACT

An impact mechanism for use in an impact printer, to deliver a printing force to drive a character element against a platen by means of a print tip movable toward and away from the platen. A rockable bail bar having an axis of rotation substantially parallel to the axis of the platen is constrained to limited angular movement toward and away from the platen by a prime mover connected to the bail bar. A push rod interconnects the print tip and the bail bar so as to close the throat distance for delivering an impact force to the platen as the bail bar is moved toward the platen. A repositioning element, having a portion thereof in alignment with the bail bar, allows the push rod to be drawn away from the platen while being interconnected thereto so as to allow access to and removal of the character element.

13 Claims, 4 Drawing Sheets

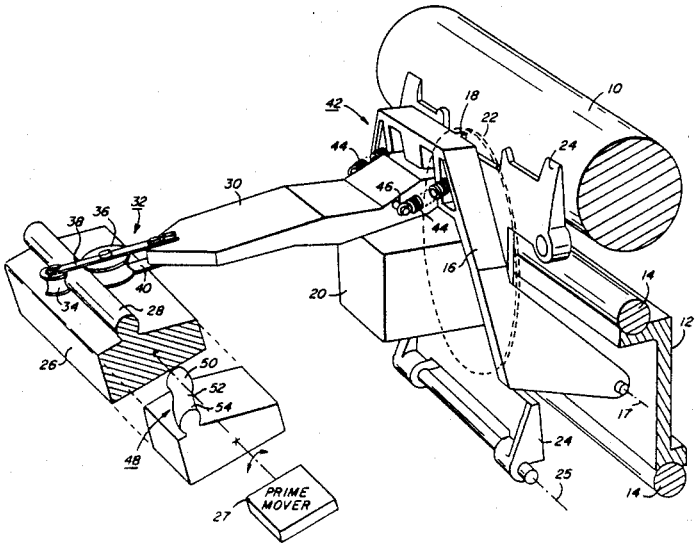

IMPACT MECHANISM FOR IMPACT PRINTER

FIELD OF THE INVENTION

This invention relates to an impact mechanism for an improved serial impact printer and, more particularly, to the drive portion thereof including a push rod coupled to a bail bar, wherein a repositioning element in alignment with the bail bar has a portion which will allow the push rod to be moved away from the platen for allowing access to a printwheel. The novel impact printer in which the present mechanism is employed is designed to substantially reduce impact noise generation during the printing operation.

BACKGROUND OF THE INVENTION

The office has, for many years, been a stressful environment due, in part, to the large number of objectionable noise generators, such as typewriters, high speed impact printers, paper shredders, and other office machinery. Where several such devices are placed together in a single room, the cumulative noise pollution may even be hazardous to the health and well being of its occupants. The situation is well recognized and has been addressed by governmental bodies who have set standards for maximum acceptable noise levels in office environments. Attempts have been made by the technical community to reduce the noise pollution. Some of these methods include enclosing impact printers in sound attenuating covers, designing impact printers in which the impact noise is reduced, and designing quieter printers based on non-impact technologies such as ink jet and thermal transfer.

Noise measurements are often referenced as dBA values. The "A" scale, by which the sound values have been identified, represents humanly perceived levels of loudness as opposed to absolute values of sound intensity. When considering sound energy represented in dB (or dBA) units, it should be borne in mind that the scale is logarithmic and that a 10 dB difference means a factor of 10, a 20 dB difference means a factor of 300, 30 dB a factor of 1000, and so on.

Typically, impact printers generate impact noise in the range of 65 to just over 80 dBA, which is deemed to be intrusive. When reduced to the high 50s dBA, the noise is construed to be objectionable or annoying. It would be highly desirable to reduce the impact noise to a dBA value in the vicinity of 50 dBA. For example, the IBM Selectric ball unit typewriters generate about 78dBA, while the Xerox Memorywriter typewriters generate about 68 dBA. The typewriter of the present invention has been typically measured at slightly less than 52dBA. This represents a dramatic improvement on the order of about 100 times less noisy than present day offices, a notable achievement toward a less stressful office environment.

Although the printing impact, produced as the hammer impacts and drives the type character pad against the ribbon, the print sheet and the platen with sufficient force to release the ink from the ribbon, is the major source of noise in the typewriter, other noise sources are present. In the presently available typewriters, the impact noise overshadows the other noises. But, once the impact noise has been substantially reduced, the other noises will no longer be extraneous. Thus, the design of a truly quiet printer requires the designer to address reducing all other noise sources, such as those arising from carriage motion, character selection, ribbon lift and advance, as well as from miscellaneous clutches, solenoids, motors and switches.

In convention ballistic hammer impact printers a hammer mass of about 2.5 grams is driven ballistically by a solenoid-actuated clapper toward the ribbon/-paper/platen combination. When the hammer hits the rear surface of the character pad it drives it against the ribbon/paper/platen combination and deforms the platen which, when it has absorbed the hammer impact energy, seeks to return to its normal shape by driving the hammer back to its home position where it must be stopped, usually by another impact. This series of impacts is the main source of the objectionable noise. Looking solely at the platen deformation impact portion of the hammer movement, the total dwell time is typically in the vicinity of 100 microseconds. At a printing speed of 30 characters per second, the mean time available between character impacts is about 30 milliseconds. The impact noise reduction achieved by the printing mechanism of the present typewriter is made possibly by significantly stretching the impact dwell time to a substantially larger fraction of the printing cycle than is typical in conventional printers. For instance, if the dwell time were stretched from 100 microseconds to 6 to 10 milliseconds, this would represent a sixty- to one hundred-fold increase, or stretch, in pulse width relative to the conventional. By extending the deforming of the platen over a longer period of time, an attendant reduction in noise output can be achieved.

The general concept implemented in the present typewriter, i.e. reduction in impulse noise achieved by stretching the deformation pulse, has been recognized for many decades. As long ago as 1918, the U.S. Pat. No. 1,261,751 (Anderson) it was recognized that quieter operation of the printing function in a typewriter may be achieved by increasing the "time actually used in making the impression". A type bar typewriter operating upon the principles described in this patent was commercially available at that time.

RELATED PATENTS AND APPLICATIONS

The quiet impact printing mechanism incorporating the present invention is described, and its theory of operation is explained in the following commonly assigned patents any one of whose disclosures are herein fully incorporated by reference. U.S. Pat. No. 4,668,112(Gabor et al), entitled "Quiet Impact Printer", relates to the manner in which the impact force in a printer of this type is controlled; U.S. Pat. No. 4,673,305 (Crystal), entitled "Printwheel For Use in a Serial Printer", relates to a printwheel modified for quiet operation when used with an alignment member; U.S. Pat. No. 4,678,355 (Gabor et al) entitled "Print Tip Contact Sensor for Quiet Compact Printer", relates to an impacting element having a sensor thereon for signaling initiation of impact; U.S. Pat. No. 4,681,469 (Gabor), entitled "Quiet Impact Printer", relates to the high mass prolonged contact period parameters of a printer of this type; U.S. Pat. No. 4,686,900 (Crystal el al), entitled "Impact Printer With Application of Oblique Print Force", relates to a shear inducing impacting element; and U.S. Pat. No. 4,737,043 (Gabor et al), entitled "Impact Mechanism for Quiet Impact Printer", relates to the unique prime mover and high mass print tip driver, including one form of the push rod which is the subject of the present invention.

The present application and two copending applications filed concurrently herewith disclose alternative push rod structures and mechanisms for opening the throat between the closely positioned elements of the traversing carriage and the platen so as to allow the operator to manipulate the printwheel in order to remove and replace it. Each copending application is entitled "Impact Mechanism for Impact Printer".

It is the primary object of this invention to provide a force transmitting member which will allow a force applying member to be maintained extremely close to the platen, in a force applying zone, during normal operation of the printer and which allows the force applying member to be retracted from the force applying zone for providing access to a character member.

It is another object of this invention to provide a force transmitting member, or push rod, for connecting a driver to an impacting device in which a portion of the driver will draw the push rod and the impacting device away from the platen in order to permit access to the printwheel for removal and replacement.

SUMMARY OF THE INVENTION

These and other objects may be carried out, in one form, by providing an impact mechanism for use in an impact printer, to deliver a printing force to drive a character element against a platen by means of a print tip normally spaced from the surface of the platen by a throat distance and movable toward and away from the platen. The character element and the print tip are supported upon a carriage mounted upon the printer for reciprocating movement in a path substantially parallel to the axis of the platen. A rockable bail bar having an axis of rotation substantially parallel to the axis of the platen is constrained to limited angular movement toward and away from the platen by a prime mover connected to the bail bar. A push rod interconnects the print tip and the bail bar so as to close the throat distance for delivering an impact force to the platen as the bail bar is moved toward the platen. A repositioning element, having a portion thereof in alignment with the bail bar, allows the push rod to be drawn away from the platen, while being interconnected thereto, so as to allow access to and removal of the character element.

BRIEF DESCRIPTION OF THE DRAWINGS

Other objects and further features and advantages of this invention will be apparent from the following, more particular description considered together with the accompanying drawings, wherein.

DETAILED DESCRIPTION OF THE ILLUSTRATED EMBODIMENT

Figure 1:
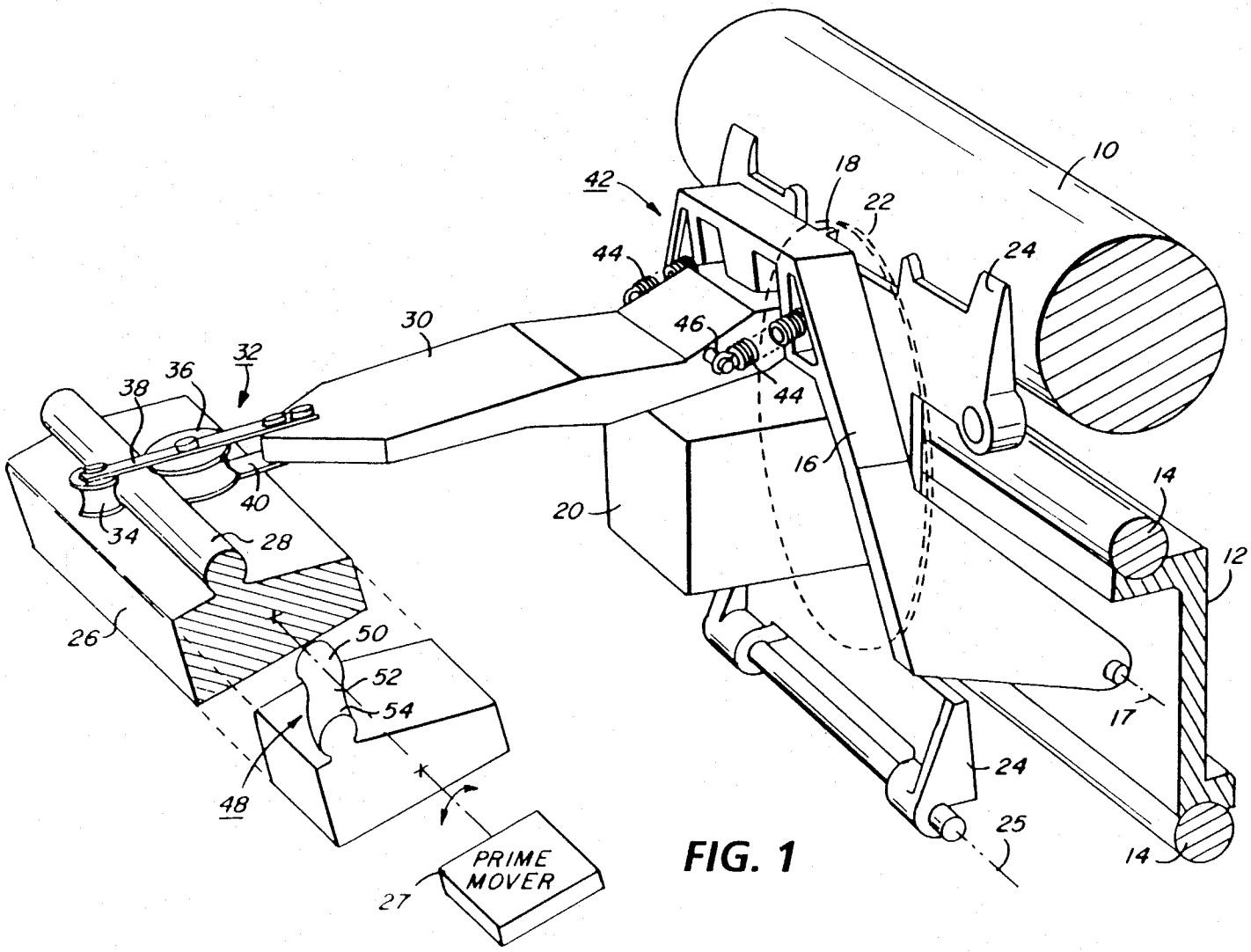
FIG. 1 is a partial perspective view showing the relevant features of a quiet impact printer in which the present invention may be incorporated, and one embodiment of the present invention.

Salient features of the quiet impact printer, in which the present invention is incorporated, are shown in FIG. 1. These include a platen 10 suitably mounted on the frame for rotation to advance and retract an image receptor on which characters may be imprinted. A carriage support beam 12 fitted with rod stock rails 14 spans the printer from side-to-side beneath and parallel to the platen for rigidly and smoothly supporting a carriage (not shown) for traversing movement parallel to the platen. A horseshoe-shaped interposer 16 is mounted upon the carriage for traversing movement therewith. It is mounted for arcuate movement about pivot axis 17 and carries print tip 18 at its apex. A printwheel motor 20 to whose shaft 21 (shown in FIGS. 2 and 3) a printwheel 22 may be secured is also mounted upon the carriage, as is a pivot frame 24 mounted for arcuate movement upon pivot axis 25 for automatically controlling the throat adjustment between the print tip 18 and the platen 10 in accordance with the thickness of the image receptor, be it a single sheet of paper, card stock or a multipart form.

A rockable bail bar 26 extending and having an axis of rotation substantially parallel to axis of said platen, is constrained to limited angular movement toward and away from said platen, by a prime mover 27 connected to said bail bar for imparting this rocking movement thereto. The prime mover may be a reciprocating voice coil motor, a rotary motor or any other suitable driver. As the bail bar is rocked, a bead or rail 28 thereon moves a rigid push rod 30 toward and away from the platen. One end 32 of the push rod rides upon the rail 28 via a pair of capturing rollers 34 and 36 secured to the push rod by upper plate 38 and lower plate 40. The lower plate rigidly supports roller 36 while the upper plate supports both rollers. At least the outer end of the upper plate 38 should be made sufficiently flexible so as to enable the roller 34 to be snapped upon the rail 28 into seating engagement. A bead 41 on the opposite end 42 of the push rod (seen in FIGS. 2 and 3) is biased into engagement with a seat on the rear wall of the print tip 18 by means of tension springs 44 extending between pins 46 on the push rod and suitable anchors on the interposer 16. Thus, during printing the drive force of the prime mover 27 is multiplied by the bail bar 26 and is translated to the print tip 18 by the push rod which may pivot about bead 41 so as to enable it to follow the arcuate path prescribed by the interposer 16. The printing forces may be provided at any position within a printing zone, traversed by the carriage, in which printing is allowed to take place.

One form of the present invention, for retracting the print tip from the platen so as to allow the operator access to the printwheel, is shown in FIG. 1. It comprises a repositioning element in the form of a static dogleg retractor 48, disposed outboard of the printing zone, on either side of the bail bar 26 (shown only on the right side) in a region where the push rod does not travel during the printing operation. The dogleg retractor may be coextensive with the rail 28 of the bail bar, or it may be located upon an independent stationary support. In each case, the retractor includes an aligned portion 50, forming a continuation of the rail 28, a transition portion 52, which curves away from the platen, and a remote portion 54, which holds the push rod in its retracted position.

Figure 2:
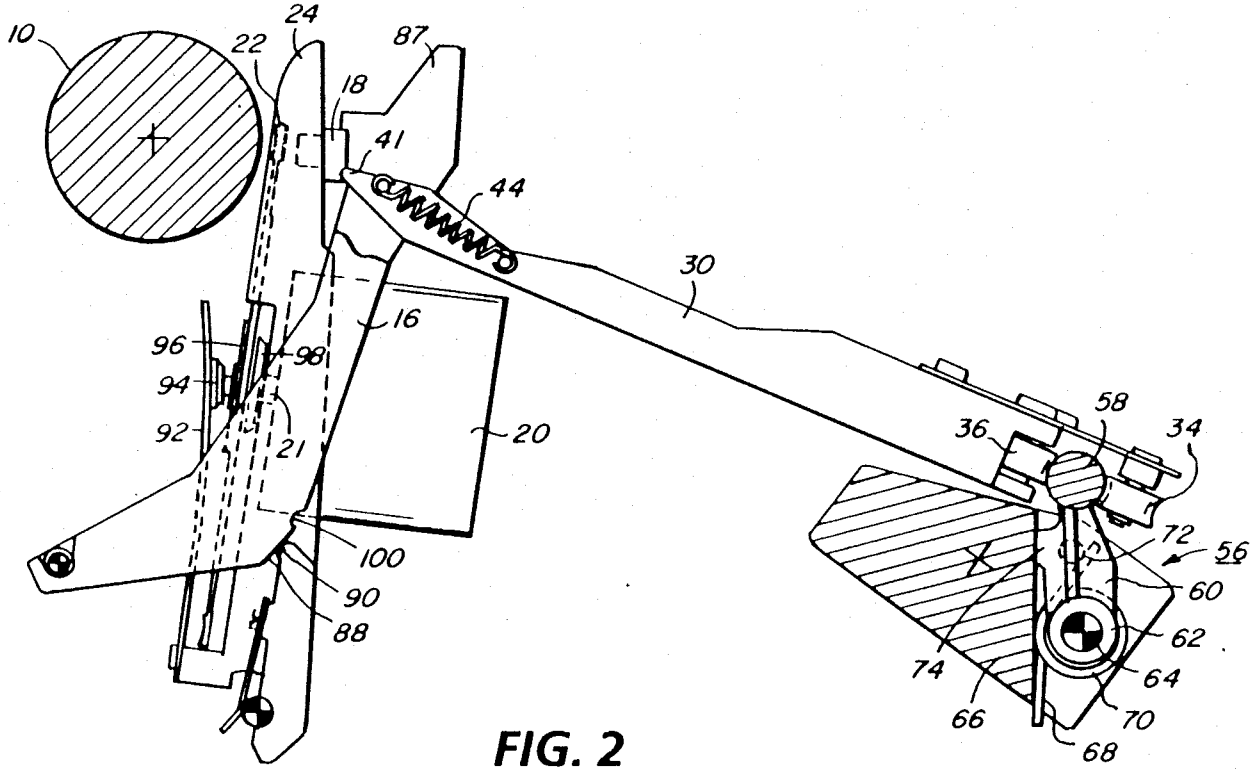
FIG. 2 is a side elevation view of a printer showing the push rod in its normal operating position, and a second embodiment of the present invention.
Figure 3:
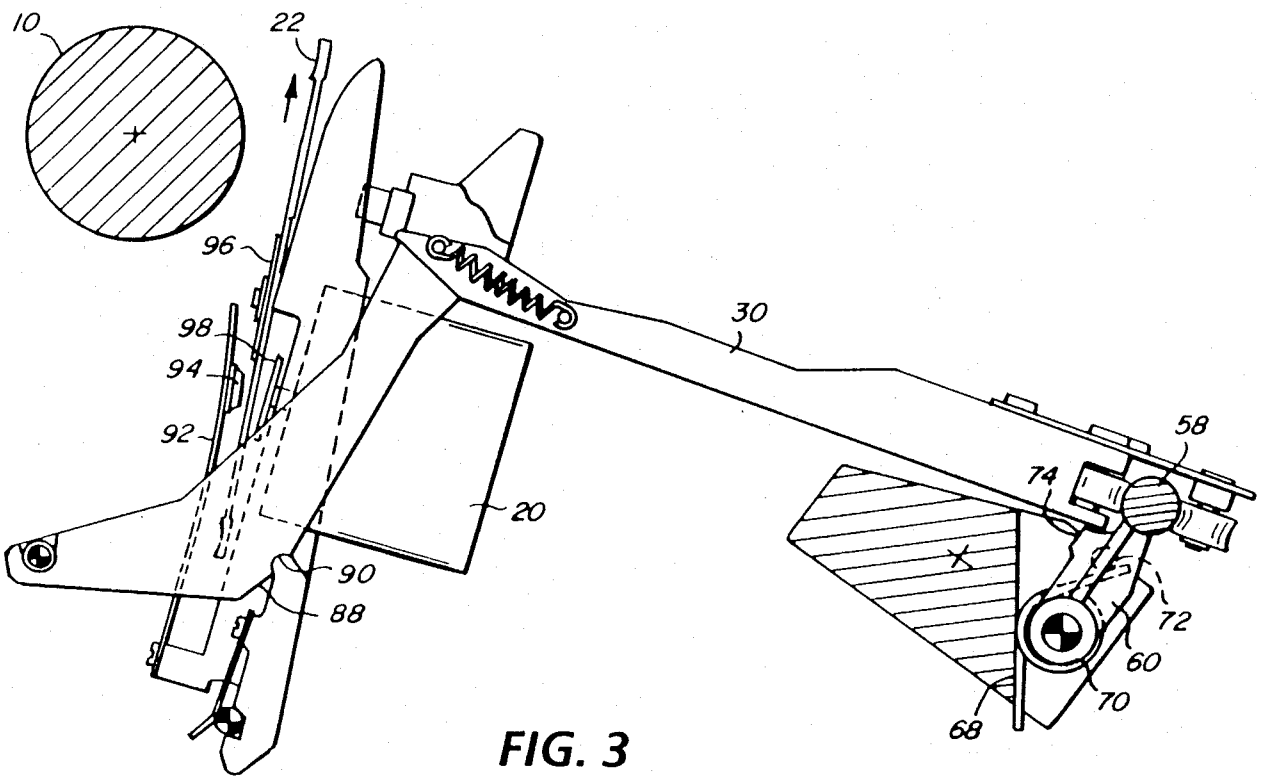
FIG. 3 is a side elevation view of the embodiment of FIG. 2 showing the push rod in its retracted position.
Figure 4:
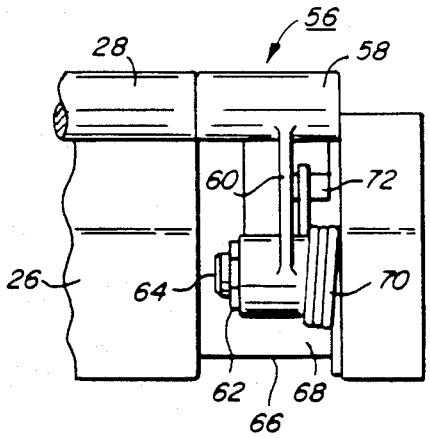
FIG. 4 is a partial front elevation view of the embodiment of FIGS. 2 and 3.

Turning now to FIGS. 2 to 4 there is shown another embodiment of the present invention. The mechanism for repositioning the push rod comprises a dynamic, pivotable retractor 56 positioned at a location outboard of the printing zone on either end of the bail bar (shown on the right side). This retractor mechanism may be mounted directly upon the bail bar, and move therewith, or it may be mounted upon an outboard stationary support independent of the bail bar. It includes a cylindrical rail portion 58, having substantially the same diameter as rail 28, located at one end of a pivot arm 60 having a bushing 62 at the opposite end. The bushing is mounted for rotation about pivot pin 64 secured to an outboard portion 66 of the bail bar. The pivot arm is housed in a seat having an internal wall 68, against which one end of a torsion spring 70 is biased with its opposite end biased against a pin 72 extending from the arm 60. Thus, the spring urges a seat 74 on the arm against internal wall 70 so as to bias the cylindrical rail portion 58 in alignment with the rail 28.

Figure 5:
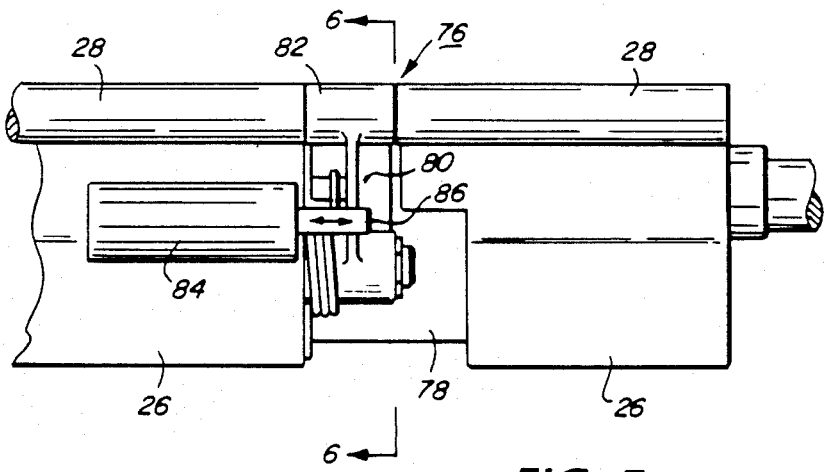
FIG. 5 is a partial front elevation view showing a third embodiment of the present invention.
Figure 6:
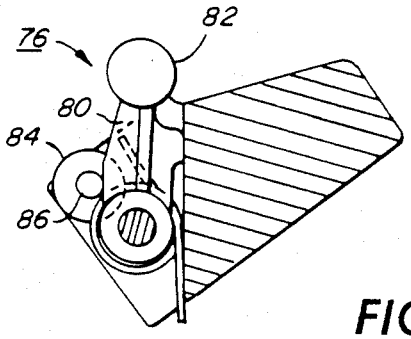
FIG. 6 is a sectional view taken substantially along line 6—6 of FIG. 5.

The third embodiment of the present invention, as illustrated in FIGS. 5 and 6, includes a pivotable retractor mechanism 76 similar to that shown in FIGS. 2 and 4, with the difference being its location relative to the bail bar 26. In the two previously described embodiments, the static retractor 48 and the dynamic retractor 56, the repositioning mechanisms were located outboard of the printing zone, at the end of the bail bar. Such a placement, while simplifying the constructional features thereof, requires a larger overall printer dimension. In this embodiment, the bail bar 26 has been modified by being cut away in the region 78 in order to accommodate a pivotable retractor arm 80 bearing a retractable rail portion 82 which is biased in the same manner as is the embodiment of FIGS. 2 to 4. In order to prevent the push rod from being repositioned, or any movement of the rail portion 82 out of alignment with the rail 28, during delivery of printing forces, a solenoid 84 is provided. The solenoid is supported within a suitable seat in the bail bar and has a retractable shaft 86 normally held in interference relationship with arm 80. Upon actuation of the solenoid to retract the shaft, the arm 80 is freed to be drawn back away from the platen. Where size is of significant concern it may be desirable to locate a retractor mechanism, such as 76 within the printing zone. It will, of course, be understood that the solenoid and its shaft must be strong enough to hold the retractable rail portion 82 in place to deliver printing forces in the range of about 8 to 40 pounds through the push rod and print tip to the platen.

With any of these repositioning mechanisms, when the operator desires to replace one printwheel with another it is not necessary to remove the ribbon cartridge (not shown) which normally overlies the push rod. First, a control signal is given, as by a depressing a dedicated function key on the keyboard or by depressing a combination of keys denoting this function, to move the carriage laterally to the retracting position, be it outboard of the printing zone as in the FIG. 1 and FIG. 2 embodiments, or to the proper position within the printing zone, as in the FIG. 5 embodiment. In the form of the FIG. 1 and FIG. 2 embodiments wherein the retractor is disposed upon an independent, stationary support, the control signal will also rotate the bail bar so as to align the rail 28 with the rail portion of the retractor mechanism. If the mechanism is of the FIG. 5 embodiment, the control signal additionally energizes the solenoid 84 to retract shaft 86 for freeing the retractor arm 80. If the device is of the FIG. 1 configuration, the mere act of moving the carriage to its outboard position moves the rollers 34 and 36 onto the dogleg retractor 48 and automatically draws back the push rod 30,interposer 16 and print tip 18 to open the throat. The throat is held open as long as the carriage is in this location and the operator may replace the printwheel.

In the FIG. 2 and FIG. 5 embodiments, once the carriage has placed the rollers 34 and 36 on the respective cylindrical rail portion 58 or 82 of its retractor mechanism, and the solenoid shaft 86 has been withdrawn in the FIG. 5 device, the operator may manually draw back on the ears 87 of the interposer 16 (which extend between the horns of the ribbon cartridge), against the torsion spring 70 to pivot the arm 60 or 80 away from the platen, so as to open the throat and obtain access to the printwheel. As the interposer is drawn back, a knee 88 thereon contacts a bearing surface 90 on the pivot frame 24, drawing it also away from the platen. Spring arm 92, upon which a printwheel retainer button 94 is mounted, is normally biased toward the pivot frame and captures the printwheel hub 96 against printwheel drive ring 98 on the printwheel shaft 21. A restraining member (not shown) prevents the spring arm from following the pivot frame as the pivot frame is moved by the interposer 16, in order to open the printwheel drive connection established between the drive ring 98 and the retainer button 94. In order to retain the interposer in its retracted position, the bearing surface 90 enters a detent recess 100 on the interposer, thereby establishing a locking relationship between these two members. Once locked, the operator may release the ears 100 and remove and replace the printwheel 22. Alternatively, the locking action may not be employed and the operator may hold the ears 100 with one hand while removing and replacing the printwheel with the other. When the printwheel replacement has been effected, the interposer need only to be pushed forward sufficiently to overcome the detent locking action. Then, the torsion spring will return the arm 60 or 80 to is home position, and the rollers 34 and 36 may be driven off the retractor mechanism and back on the rail 28.

It should be understood that the present disclosure has been made only by way of example, and that numerous changes in details of construction and the combination and arrangement of parts may be resorted to without departing from the true spirit and scope of the invention as hereinafter claimed.

What is claimed:

1. The impact mechanism as defined in claim 2 wherein said character element is secured in driving engagement when said print tip is normally spaced by said throat distance, and including means connected to said push rod for releasing said printwheel from said driving engagement as said push rod is repositioned.

2. An impact mechanism in an impact printer, for delivering a printing force to drive a character element against a platen by means of a print tip normally spaced from the surface of said platen by a throat distance and movable toward and away from said platen, said character element and said print tip being supported upon a carriage mounted upon said printer for reciprocating movement in a path substantially parallel to the axis of said platen, including a rockable bail bar having an axis of rotation substantially parallel to the axis of said platen, and constrained to limited angular movement toward and away from said platen, a prime mover connected to said bail bar for imparting the rocking movement thereto, a push rod for interconnecting said print tip and said bail bar so as to close said throat distance for delivering impact forces to said platen as said bail bar is moved toward said platen, means for movably coupling said push rod and said bail bar, rail means on said bail bar for receiving said means for movably coupling, for delivering impact forces from said prime mover to said push rod, and repositioning means, comprising a terminal extension of said rail means, and having a receiving portion in alignment with said rail means so as to accept said means for movably coupling from said rail means, and a remaining portion for maintaining the coupling between said repositioning means and said push rod as said means for movably coupling is moved away from said platen by said push rod and the distance between said print tip and said platen is increased in order to allow said character element to be removed wherein said remaining portion comprises a curved rail extension having a remote portion which is further away from said platen than said receiving portion and said means for movably coupling is coupled with said remote portion when said character element is removed.

3. The impact mechanism as defined in claim 4 wherein said repositioning means is integral with said rail means.

4. The impact mechanism as defined in claim 2 wherein said repositioning means is independent of and lies adjacent to said rail means.

5. An impact mechanism in an impact printer, for delivering a printing force to drive a character element against a platen by means of a print tip normally spaced from the surface of said platen by a throat distance and movable toward and away from said platen, said character element and said print tip being supported upon a carriage mounted upon said printer for reciprocating movement in a path substantially parallel to the axis of said platen, including a rockable bail bar having an axis of rotation substantially parallel to the axis of said platen, and constrained to limited angular movement toward and away from said platen, a prime mover connected to said bail bar for imparting the rocking movement thereto, a push rod for interconnecting said print tip and said bail bar so as to close said throat distance for delivering impact forces to said platen as said bail bar is moved toward said platen, means for movably coupling said push rod and said bail bar, rail means on said bail bar for receiving said means for movably coupling, for delivering impact forces from said prime mover to said push rod, and repositioning means having a receiving portion in alignment with said rail means so as to accept said means for movably coupling from said rail means, and a remaining portion for maintaining the coupling between said repositioning means and said push rod as said means for movably coupling is moved away from said platen by said push rod and the distance between said print tip and said platen is increased in order to allow said character element to be removed wherein said repositioning means comprises a movable section of rail coextensive with said rail means, and further includes means for mounting said movable section of rail for movement toward and away from said platen, biasing means for urging said section of rail toward said platen, and locating means for aligning said receiving portion with said rail means.

6. The impact mechanism as defined in claim 5 wherein said repositioning means comprises a terminal extension of said rail means.

7. The impact mechanism as defined in claim 5 wherein said repositioning means is integral with said rail means.

8. The impact mechanism as defined in claim 6 wherein said repositioning means is integral with said rail means.

9. The impact mechanism as defined in claim 5 wherein said repositioning means is independent of and lies adjacent to said rail means.

10. The impact mechanism as defined in claim 6 wherein said repositioning means is independent of and lies adjacent to said rail means.

11. The impact mechanism as defined in claim 5 wherein said repositioning means is located intermediate the ends of said rail means.

12. The impact mechanism as defined in claim 11 including restraining means for preventing said repositioning means for being moved out of alignment with said rail means in order to allow it to deliver impact forces to said push rod.

13. The impact mechanism as defined in claim 12 wherein said restraining means is a solenoid pin.

* * * * *